US008396403B2

(12) United States Patent
Breitenbach et al.

(10) Patent No.: US 8,396,403 B2
(45) Date of Patent: Mar. 12, 2013

(54) TONER ROLLER WITH AN INSULATION LAYER COMPRISING POLYMER

(75) Inventors: Alexander Breitenbach, Munich (DE); Thomas Schwarz-Kock, Marzling (DE)

(73) Assignee: OcéSystems GmbH, Poing (DE)

( * ) Notice: Subject to any disclaimer, the term of this patent is extended or adjusted under 35 U.S.C. 154(b) by 23 days.

(21) Appl. No.: 12/812,551

(22) PCT Filed: Jan. 9, 2009

(86) PCT No.: PCT/EP2009/050200

§ 371 (c)(1),
(2), (4) Date: Jul. 12, 2010

(87) PCT Pub. No.: WO2009/087208

PCT Pub. Date: Jul. 16, 2009

(65) Prior Publication Data

US 2010/0284711 A1 Nov. 11, 2010

(30) Foreign Application Priority Data

Jan. 10, 2008 (DE) ..... 10 2008 003 818

(51) Int. Cl.
*G03G 15/08* (2006.01)

(52) U.S. Cl. ..... 399/286

(58) Field of Classification Search ..... 399/176, 399/239, 265, 279, 286, 313, 330, 331, 357, 399/55, 285; 492/17, 18, 56, 59; 430/123.3
See application file for complete search history.

(56) References Cited

U.S. PATENT DOCUMENTS

| | | | | |
|---|---|---|---|---|
| 4,827,868 | A | 5/1989 | Tarumi et al. | |
| 4,990,963 | A * | 2/1991 | Yamamoto et al. | 399/286 |
| 5,039,598 | A | 8/1991 | Abramsohn et al. | |
| 5,051,332 | A * | 9/1991 | Hosoya et al. | 430/101 |
| 5,434,653 | A * | 7/1995 | Takizawa et al. | 399/284 |
| 5,473,418 | A | 12/1995 | Kazakos et al. | |
| 5,481,341 | A * | 1/1996 | Sypula et al. | 399/239 |
| 5,851,719 | A | 12/1998 | Takei et al. | |
| 5,906,904 | A | 5/1999 | Parikh et al. | |
| 5,918,098 | A * | 6/1999 | Van Bennekom | 399/333 |
| 6,052,550 | A * | 4/2000 | Thornton et al. | 399/237 |
| 6,061,545 | A * | 5/2000 | Cerrah | 399/330 |
| 6,253,053 | B1 * | 6/2001 | Litman et al. | 399/286 |
| 6,327,452 | B1 | 12/2001 | Jaskowiak et al. | |
| 6,341,420 | B1 | 1/2002 | Swartz et al. | |
| 6,393,243 | B1 * | 5/2002 | Satoh et al. | 399/286 |
| 6,409,645 | B1 * | 6/2002 | Paasonen et al. | 492/56 |
| 6,458,063 | B2 * | 10/2002 | Kodama | 492/59 |
| 6,989,182 | B2 * | 1/2006 | Chen et al. | 428/36.8 |
| 7,907,878 | B2 * | 3/2011 | Takagi et al. | 399/286 |
| 2002/0028096 | A1 | 3/2002 | Satoh | |
| 2003/0175055 | A1 * | 9/2003 | Machida et al. | 399/285 |
| 2007/0177909 | A1 | 8/2007 | Takagi | |
| 2008/0047142 | A1 * | 2/2008 | Eun et al. | 29/895.21 |

FOREIGN PATENT DOCUMENTS

| | | |
|---|---|---|
| DE | 37 05 341 A1 | 8/1987 |
| DE | 699 28 310 T2 | 10/1999 |
| EP | 0 435 598 A2 | 7/1991 |

(Continued)

*Primary Examiner* — Robert Beatty
(74) *Attorney, Agent, or Firm* — Schiff Hardin LLP

(57) ABSTRACT

In a toner roller for use in a developer station for a printer or copier, a roller-shaped base body has an electrically conductive surface on which is arranged an insulation layer. The insulation layer comprises plastic and has a layer thickness and arranged between 150 μm and 1000 μm. The insulation layer also comprises a filler where the filler comprises electrically conductive additives.

15 Claims, 3 Drawing Sheets

FOREIGN PATENT DOCUMENTS

| | | | | |
|---|---|---|---|---|
| JP | 06138764 | A | * | 5/1994 |
| JP | 10268629 | A | * | 10/1998 |
| JP | 2005004196 | A | * | 1/2005 |
| JP | 2007094106 | A | * | 4/2007 |

* cited by examiner

TONER ROLLER WITH AN INSULATION LAYER COMPRISING POLYMER

BACKGROUND

The preferred embodiment concerns a toner roller for use in a developer station for a printer or copier with a roller-shaped base body that has an electrically conductive surface on which is arranged an insulation layer. The preferred embodiment also concerns a method to produce a toner roller.

Toner rollers are important structural elements in developer stations for printers or copiers. A typical toner roller is used as an applicator roller that is situated opposite an intermediate carrier, for example a photoconductor roller or a photoconductor belt. During operation the applicator roller carries a homogeneous layer of toner particles. The surface of the intermediate carrier bears a latent charge image corresponding to an image to be printed. As a result of electrical field forces, toner particles are attracted by the surface of the intermediate carrier and are transferred from the applicator roller to this surface (possibly while overcoming an air gap) and arrange themselves corresponding to the latent charge image.

The roller-shaped base body has an electrically conductive surface so that the toner particles can be held on the surface of the toner roller with the aid of electrical voltages. So that voltage flashovers do not occur within the developer station and also towards the intermediate carrier, the toner roller must be provided with an insulation layer. The insulation layer must be sufficiently abrasion-resistant to the developer mixture (comprising toner particles and ferromagnetic carrier particles).

Toner rollers which use a ceramic layer as an insulation layer are known from U.S. Pat. No. 6,327,452 B1 and U.S. Pat. No. 5,473,418. Such ceramic layers have pores that can absorb moisture, which reduces the capability of the toner roller to accept toner particles and in particular to release toner particles.

SUMMARY

It is an object to specify a toner roller and a method to produce a toner roller whose surface is suitable to bear a toner roller and that is high voltage-stable and abrasion-resistant.

In a toner roller for use in a developer station for a printer or copier, a roller-shaped base body has an electrically conductive surface on which is arranged an insulation layer. The insulation layer comprises plastic and has a layer thickness and arranged between 150 μm and 1000 μm. The insulation layer also comprises a filler where the filler comprises electrically conductive additives.

DESCRIPTION OF THE PREFERRED EMBODIMENT

Figure 1:
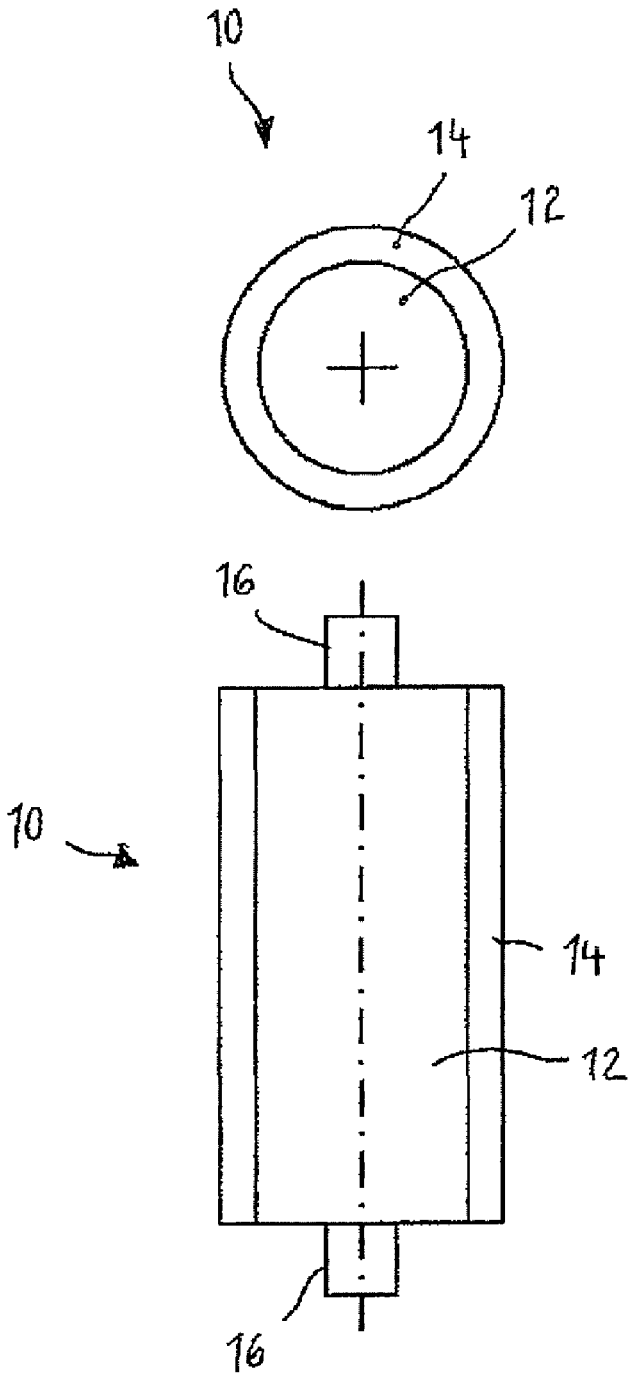
FIG. 1 is a cross section and longitudinal section through a toner roller.

For the purposes of promoting an understanding of the principles of the invention, reference will now be made to preferred embodiment/best mode illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates are included.

According to the preferred embodiment, the insulation layer contains plastic and has a layer thickness in a range between 150 μm and 1000 μm. The insulation layer has the shape of a cylindrical shell and contacts the surface of the base body.

According to a preferred exemplary embodiment, in addition to plastic the insulation layer also comprises filler materials that are supplied so that they provide a defined high-voltage stability and a defined abrasion-resistance. In particular, those plastics from the family of urethanes—for example PU polyurethane) or fluorocarbons (polyfluorocarbons, for example PTFE (Teflon), ECTFE, ETFE, PVDF, PFA—are considered as plastics. The plastics from the urethane family are characterized by their isocyanate or NCO group; those of the polyfluorocarbons are characterized by the replacement of CH2 groups with fluorine atoms. Both plastic families are characterized in that large quantities of filler materials can be added. Moreover, they are particularly abrasion-resistant due to their polymer structure. To adjust the electrical resistance, electrically conductive additives are used, advantageously conductive carbon black or nanoparticles (carbon nanotubes, for example). Non-plastics—for example SiO2, carbon, ceramic oxides, aluminum oxide, titanium oxide and/or chromium oxide and mixtures of these—are in particular considered as fillers that can be added to the plastic.

According to a further aspect of the preferred embodiment, a method is specified for the production of a toner roller.

FIG. 1 shows a cross section through a toner roller 10 in the upper part of the image and a longitudinal section of this in the lower part of the image. The toner roller 10 comprises a roller-shaped base body 12 and an insulation layer 14. The insulation layer 14 has a layer thickness in a range between 150 μm and 1000 μm, advantageously in a range between 400 μm and 600 μm. As in the present example, the base body 12 can be designed as a solid roller with journals 16. However, it is also possible to use a hollow roller as a base body 12. The roller-shaped base body 12 is advantageously made of aluminum or an aluminum alloy (including wrought aluminum alloy, casting aluminum alloy and die-casting aluminum alloy) or of pure titanium or a titanium alloy. Alternatively, the base body can also be produced from plastic that is provided with an electrically conductive surface. The electrical surface of the base body 12 is important because a direct voltage is applied to this, which direct voltage attracts the toner particles to the outer surface of the insulation layer 14 as a result of electrical field forces. The specific resistance of the electrically conductive material of the base body 12 or its conductive surface lies in a range less than $10.0\Omega\cdot mm^2/m$. A coating with antistatic effects is provided so that possibly arising surface charges can be dissipated again (relative: 10ˆ6 Ohm cm<layer<10ˆ14 Ohm cm or, respectively, absolute<10ˆ8 Ohm). The layer thickness results from these requirements. The damping (resulting from this) of an electrical DC field that is applied to the base body may amount to 80% at most relative to the roller surface. The capacitance of the layer structure must be between 100 pF (picofarad) and 1 μF (microfarad) so that a low capacitive resistance is achieved. Ideally, the relative permittivity of the layer is more than 7. The electrical values of the coating apply for frequency ranges given a sinusoidal oscillation between 0 Hz and 1 MHz.

Figure 2:
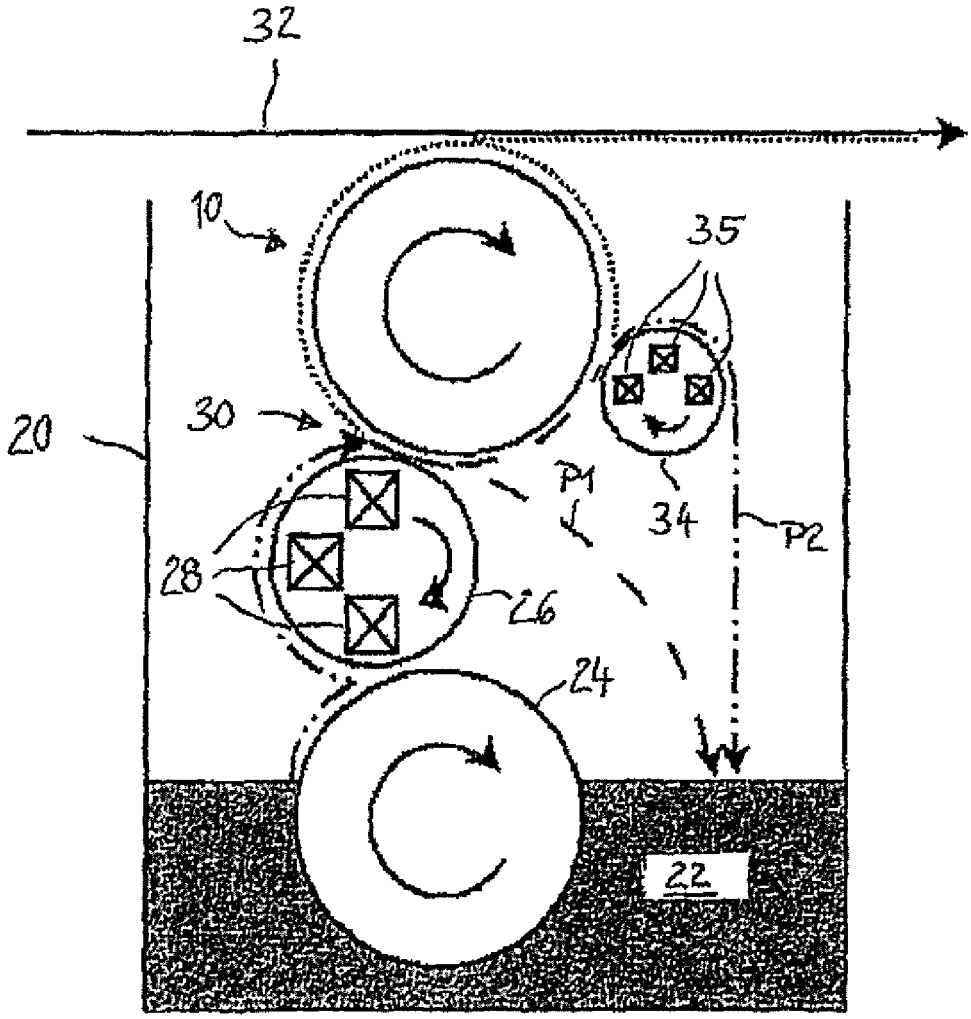
FIG. 2 shows the use of a toner roller in a developer station.

FIG. 2 shows the use of the toner roller 10 in a developer station 20. A developer mixture 22 comprising toner particles and ferromagnetic carrier particles is transported to an inking roller 26 with the aid of a mixture dredger 24. The inking roller 26 contains as a magnet stator magnetic elements 28 which attract the magnetic carrier particles. Upon rotation of the shell of the inking roller 26, the carrier particles are transported further upward together with the toner particles adhering to them. Toner particles and carrier particles separate in the contact region 30 of inking roller 26 and toner roller 10. The toner particles are held and transported further upward as a result of electrical field forces on the insulation layer 14 of the toner roller 10 while the ferromagnetic carrier particles are transported in the direction of arrow P1 back to the developer mixture 22 or to a cleaning roller 34.

The toner particles adhering to the surface of the toner roller are brought to the photosensitive layer of an intermediate carrier 32 (for example a belt-shaped photoconductor) and jump over to this photosensitive layer and ink this image as a result of electrical field forces that form (due to a latent charge image) between the photosensitive layer of the intermediate carrier 32 and the surface of the toner roller 10. Due to the jump behavior of the toner particles in the contact region of the toner roller 10 and intermediate carrier 32, the toner roller 10 that is used in this way is frequently also called a jump roller. The untransferred toner particles are cleaned off by the cleaning roller 34 (which likewise contains a magnet stator with magnet elements 35) using ferromagnetic carrier particles. The mixture of cleaned-off toner particles and carrier particles is supplied to the developer mixture 22 again according to arrow P2.

Figure 3:
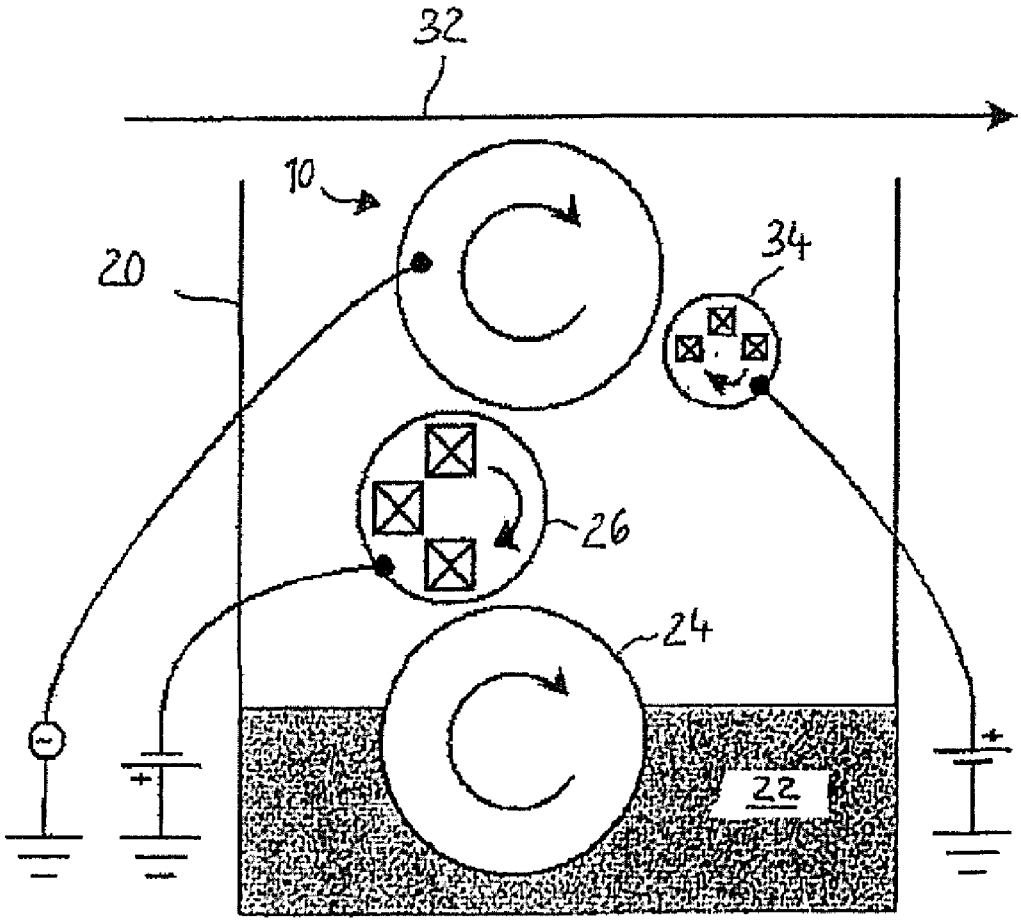
FIG. 3 illustrates potential ratios in the developer station.

FIG. 3 shows an example of electrical potential ratios in the developer station 20. The inking roller 26 is charged with a direct voltage potential while the toner roller 10 is charged with an alternating voltage on which a direct voltage can be superimposed. The cleaning roller 34 is in turn charged with a potential which is opposite the potential of the inking roller 26. The applied potentials are selected so that the toner particles are conveyed upward from the developer mixture 22 towards the intermediate carrier 32 on the one hand and can be released again from the toner roller 10 on the other hand in order to jump over to the photosensitive layer of the intermediate carrier 32.

Because of the relatively narrow gaps (typically 1.0 mm), an increased mechanical stress of the roller surfaces occurs in the contact regions between inking roller 26 and toner roller 10 as well as between toner roller 10 and cleaning roller 34 due to the hard ferromagnetic carrier particles that are transported through these gaps. The insulation layer 14 on the toner roller 10 must accordingly have a high abrasion-resistance so that the wear is low and a long operating life is achieved for the toner roller 10. Moreover, the insulation layer 14 must be provided so that no short occurs between the individual rollers due to the applied high voltages. Therefore, in the toner roller 10 an insulating coating is required while electrically conductive coatings can be provided in the inking roller 26 and the cleaning roller 34. The potential difference relative to the cleaning roller 34 amounts to approximately 2 kVss given the positive half-wave of the alternating voltage applied to the toner roller 10, and even up to 3 kVss given a negative half-wave. A qualitative high-grade operation is therefore only possible when a sufficient high-voltage resistance is provided by the insulation layer 14 of the toner roller 10. The requirements for a high abrasion resistance on the one hand and a high high-voltage stability on the other hand make it difficult to find suitable materials for the insulation layer 14. The thickness of the insulation layer 14 typically lies in a range from 150 μm to 1000 μm. A layer that is too thin can lead to high-voltage flashovers. Moreover, a thin layer can produce problems with regard to the abrasion resistance. Given an insulation layer that is too thick, the electrical insulation effect is too great.

Examples of the insulation layer 14 are specified in the following.

EXAMPLE 1

The insulation layer also is comprised of fillers in addition to plastic. Electrically conductive additives (in particular conductive carbon black) are added to the filler. Non-plastics, for example SiO2, carbon, aluminum oxide, titanium oxide and/or chromium oxide, are considered as filler. The proportion of filler in the insulation layer is between 0 and 15% by weight, advantageously in a range from 3.6 to 15% by weight. The proportion of electrically conductive additives in the insulation layer lies in a range from 0.1 to 0.5% by weight, advantageously 0.2 to 0.28% by weight.

EXAMPLE 2

Like Example 1, wherein PTFE (Teflon) is provided as a plastic.

EXAMPLE 3

Like Example 1, wherein PVDF (for example Kynar, PA (polyamide), PE, PVC, polyolefin or polyurethane (PU) is used as a plastic.

EXAMPLE 4

The insulation layer consists of polyurethane (PU) in pure form, i.e. without fillers.

The insulation layers that can be achieved with the examples have the following properties:

a) they are wear-resistant and abrasion-resistant against ferromagnetic carrier particles and iron powder;
b) they are electrically insulating;
c) they are high-voltage stable up to at least 2 kVss;
d) the specific forward resistance of the insulation layer is at least $10^7$ Ωcm;
e) the surface properties are barely affected by environmental influences (for example humidity, temperature);
f) the surface roughness amounts to an average peak-to-valley height Rz <2 μm;
g) the cylindrical deviation of the surface from circular form amounts to <7 μm;
h) the surface has advantageous anti-adhesion properties.

The proposed insulation layers have a sufficient high-voltage stability. There is thereby no flaking damage to the outer surface, whereby longer run times result for the toner roller (and therefore for the developer station). The cited insulation layers are sufficiently abrasion-resistant. Via the use of plastic in the insulation layer, the surface is well sealed so that this absorbs no moisture, which can occur given surfaces provided with pores. A post-processing (for example polishing) can be omitted given specific plastics.

Different production methods to produce a toner roller are described in the following:

Production Method 1:

Plastic (in particle form or powder form) according to the examples cited further above is mixed with the fillers (in particle form or powder form) into a dispersion or suspension. The base body is immersed in the dispersion so that it is coated with a thin layer of the dispersion. After drying the layer, this is processed via material removal (for example via polishing) in order to obtain the required geometric dimensions and the required roughness and surface shape.

Production Method 2:

A film is produced from a mixture of plastic and fillers. This film is fused at two ends with one another and applied on the base body. A post-processing subsequently takes place in order to achieve the geometric dimensions.

Production Method 3:

A heat-shrinkable sleeve is produced from the mixture of plastic and the fillers, which sleeve is drawn over the base body. A post-processing can subsequently take place.

Production Method 4:

A mixture of plastic and fillers is used in order to coat the base body in a powder coating method (for example whirl sintering, thermal plastic powder process, thermal gun spraying, electrostatic coating). A post-processing subsequently takes place.

In the aforementioned production methods, polyurethane in pure form can also be used instead of the mixture of plastic and fillers.

Composite material—for example glass composite (for example fiberglass-reinforced plastic) or carbon fiber composite (for example carbon fiber-reinforced plastic)—is also suitable as a material for the base body. In such composite materials the plastic proportion can amount to less than 50%. Ceramic or glass can likewise be used as a material, for example in pipe form. These materials are to be provided with a conductive carbon fiber on their surface. Given the use of a conductive carbon fiber (for example a wound carbon fiber tube) for the base body, a separately applied conductive layer can be omitted if the conductive carbon fiber has a sufficient conductivity.

Although a preferred exemplary embodiment is shown and described in detail in the drawings and in the preceding specification, this should be viewed as purely exemplary and not as limiting the invention. It is noted that only the preferred exemplary embodiment is shown and described, and all variations and modifications that presently or in the future lie within the protective scope of the invention should be protected.

The invention claimed is:

1. A developer station for a printer or copier, comprising:

a non-liquid toner source;

a non-liquid developer toner roller to which non-liquid toner comprising toner particles and carrier particles is transferred from the toner source;

an electrostatic image carrying photoconductor member to which the toner particles are transferred by jumping from the toner roller across a gap provided between the toner roller and the photoconductor member;

said toner roller comprising only two circular members, one of which is a single roller-shaped base body having an electrically conductive surface on which is directly arranged, as the other circular member, only one insulation layer;

the insulation layer comprising plastic having a sealed outer peripheral surface with no pores and having a layer thickness in a range between 150 μm and 1000 μm;

in addition to said plastic the insulation layer also comprising a filler; and the filler comprising electrically conductive additives.

2. The developer station according to claim 1, in which the filler comprises at least one of the elements selected from the group consisting of $S_iO_2$, carbon, ceramic oxide, aluminum oxide, titanium oxide and chromium oxide.

3. The developer station according to claim 2 in which a proportion of the filler in the insulation layer amounts to between 0 and 15% by weight.

4. The developer station according to claim 1, in which a proportion of electrically conductive additives in the insulation layer is in a range from 0.1 to 0.5% by weight.

5. The developer station according to claim 1, in which PTFE is provided as said plastic for the insulation layer.

6. The developer station according to claim 1, in which the insulation layer comprises polyurethane in pure form.

7. The developer station according to claim 1, in which the insulation layer is applied on the base body in the form of a heat-shrinkable sleeve.

8. The developer station according to claim 1, in which the insulation layer is formed by a film fused at ends.

9. The developer station according to claim 1, in which the roller-shaped base body is formed from aluminum or an aluminum alloy, or of pure titanium or a titanium alloy.

10. The developer station according to claim 1, in which the base body comprises plastic, glass, ceramic or a composite material and provided with an electrically conductive surface.

11. A method for production of a non-liquid developer toner roller comprising only two circular members in a developer station of a printer or copier, and wherein non-liquid toner comprising toner particles and carrier particles is transferred from a toner source to said toner roller and said toner roller transfers the toner particles to an electrostatic image carrying photoconductor member by jumping from the toner roller across a gap provided between the toner roller and the photoconductor member in the developer station, comprising the steps of:

to produce said toner roller, providing only one roller-shaped base body having an electrically conductive surface as one of said only two circular members;

applying as said other circular member only one insulation layer directly on the only one base body in the form of a heat-shrinkable sleeve comprising plastic and a filler, said filler comprising electrically conductive additives; and heating the heat shrinkable sleeve to shrink the sleeve, after shrinking said sleeve having a layer thickness in a range between 150 μm and 1000 μm, and having a sealed outer peripheral surface with no pores.

12. A method for production of a non-liquid developer toner roller comprising only two circular members in a developer station of a printer or copier, and wherein non-liquid toner comprising non-liquid developer toner particles and carrier particles is transferred from a toner source to said toner roller and said toner roller transfers said toner particles to an electrostatic image carrying photoconductor member by jumping from the toner roller across a gap provided between the toner roller and the photoconductor member in the developer station, comprising the steps of:

to produce said toner roller, providing only one roller-shaped base body having an electrically conductive surface as one of said only two circular members; and as said other circular member, applying an insulation layer directly on the base body in the form of a film and fusing the film at ends, said film comprising plastic and a filler, said filler comprising electrically conductive additives and said film having a layer thickness in a range between 150 μm and 1000 μm, and having a sealed outer peripheral surface with no pores.

13. A method for production of a non-liquid developer toner roller comprising only two circular members in a developer station of a printer or copier, and wherein non-liquid toner comprising toner particles and carrier particles is transferred from a toner source to said toner roller and said toner roller transfers toner particles to an electrostatic image carrying photoconductor member by jumping from the toner roller across a gap provided between the toner roller and the photoconductor member in the developer station, comprising the steps of:

to produce said toner roller, providing only one roller-shaped base body having an electrically conductive surface as one of said only two circular members;

as said other circular member, applying an insulation layer directly on the base body, said insulation layer comprising plastic and a filler, said filler comprising electrically conductive additives, said insulation layer being formed in an immersion process; and subsequently drying the insulation layer, and after drying said insulation layer having a layer thickness in a range between 150 μm and 1000 μm and having a sealed outer peripheral surface with no pores.

14. A method for production of a non-liquid developer toner roller comprising only two circular members in a developer station of a printer or copier, and wherein toner comprising toner particles and carrier particles is transferred from a toner source to said toner roller and said toner roller transfers said toner particles to an electrostatic image carrying photoconductor member by jumping from the toner roller across a gap provided between the toner roller and the photoconductor member in the developer station comprising the steps of:

to produce said toner roller, providing only one roller-shaped base body having an electrically conductive surface as one of said only two circular members; and as said other circular member, applying an insulation layer directly on the base body, said insulation layer comprising plastic and a filler, said filler comprising electrically conductive additives, and wherein said step of applying comprises generating the insulation layer via a powder coating process or a gun spraying, said insulation layer having a layer thickness in a range between 150 μm and 1000 μm and having a sealed outer peripheral surface with no pores.

15. The developer station according to claim 14 wherein said gap has a width of substantially 1 mm.

* * * * *